US009834284B2

(12) United States Patent
Hesse

(10) Patent No.: US 9,834,284 B2
(45) Date of Patent: Dec. 5, 2017

(54) AUTONOMOUS SUBMERSIBLE VEHICLE AND METHOD FOR PULLING IN SAME

(71) Applicant: ATLAS ELEKTRONIK GmbH, Bremen (DE)

(72) Inventor: Sven-Christian Hesse, Bremen (DE)

(73) Assignee: ATLAS ELEKTRONIK GmbH, Bremen (DE)

( * ) Notice: Subject to any disclaimer, the term of this patent is extended or adjusted under 35 U.S.C. 154(b) by 162 days.

(21) Appl. No.: 14/774,154

(22) PCT Filed: Mar. 6, 2014

(86) PCT No.: PCT/DE2014/100082

§ 371 (c)(1),
(2) Date: Sep. 10, 2015

(87) PCT Pub. No.: WO2014/173392

PCT Pub. Date: Oct. 30, 2014

(65) Prior Publication Data

US 2016/0023722 A1 Jan. 28, 2016

(51) Int. Cl.

| | |
|---|---|
| ***B63B 27/16*** | (2006.01) |
| ***B63B 27/36*** | (2006.01) |
| ***B63G 8/42*** | (2006.01) |
| ***B63G 8/00*** | (2006.01) |

(52) U.S. Cl.

CPC ..... *B63B 27/16* (2013.01); *B63B 27/36* (2013.01); *B63G 8/001* (2013.01); *B63G 8/42* (2013.01); *B63B 2027/165* (2013.01)

(58) Field of Classification Search

CPC ..... B63B 27/16; B63B 27/36; B63G 8/42; B63G 8/001

See application file for complete search history.

(56) References Cited

U.S. PATENT DOCUMENTS

| | | | | |
|---|---|---|---|---|
| 5,378,851 | A | 1/1995 | Brooke et al. | |
| 7,350,475 | B2 * | 4/2008 | Borgwarth | B63B 21/56 114/260 |
| 7,699,015 | B1 | 4/2010 | Said | |
| 2012/0118217 | A1 * | 5/2012 | Bertelsen | B63G 8/001 114/326 |

FOREIGN PATENT DOCUMENTS

| | | |
|---|---|---|
| EP | 2452868 | 5/2012 |
| FR | 2352708 | 12/1977 |
| GB | 2279045 | 12/1994 |

* cited by examiner

*Primary Examiner* — Edwin Swinehart
(74) *Attorney, Agent, or Firm* — Pearl Cohen Zedek Latzer Baratz LLP

(57) ABSTRACT

A method for pulling an autonomous submersible vehicle into a mother ship. The method includes the steps of letting out a floating line from the mother ship, allowing at least part of a capturing line to rise from the submersible vehicle using a capturing buoy, to cause the submersible vehicle to cross under the floating line in such a way that the capturing line with the capturing buoy becomes caught on the floating line, and to draw the submersible vehicle to the mother ship by pulling in the floating line.

13 Claims, 5 Drawing Sheets

AUTONOMOUS SUBMERSIBLE VEHICLE AND METHOD FOR PULLING IN SAME

CROSS-REFERENCE TO RELATED APPLICATIONS

This application is a National Phase Application of PCT International Application No. PCT/DE2014/100082, entitled "AUTONOMOUS SUBMERSIBLE VEHICLE AND METHOD FOR PULLING IN SAME", International Filing Date Mar. 6, 2014, published on Oct. 30, 2014 as International Publication No. WO 2014/173392, which in turn claims priority from German Patent Application No. 10 2013 207 731.9, filed Apr. 26, 2013, all of which are incorporated herein by reference in their entirety.

FIELD OF THE INVENTION

The present invention relates to a method for picking up an autonomous submersible vehicle. Furthermore, the present invention relates to an autonomous watercraft and it relates to a vehicle assembly with an autonomous submersible vehicle and a mother ship for this submersible vehicle.

BACKGROUND

Autonomous submersible vehicles are well known; they are usually released by a mother ship into the ocean or large lakes; then, they submerge and explore largely autonomously the corresponding submarine area, e.g. to check the laying of a submarine cable, to search for mineral deposits or to explore the flora and fauna under water. Following completion of such a submerged operation, the submersible vehicle is taken back aboard the mother ship, for example, to replace or recharge one or more batteries of the submersible vehicle. The submersible vehicle can also be repaired or maintained on-board the mother ship, or the results of the submerged operation are evaluated.

The problem with such a pick-up of the submersible vehicle is that the sea and large lakes are usually characterized by a certain sea state that powerfully moves both the mother ship and the submersible vehicle once it surfaces. Thus, even spotting the afloat submersible vehicle from the mother ship can be problematic, in particular, rough seas makes it difficult to moor a deck crane to a fastening hook or the like of the submersible vehicle.

Solutions are known, in which the mother ship lowers a receiving cage into the water to a depth at which the impact of rough seas is only slightly noticeable. To facilitate pick-up, the submersible vehicle then maneuvers into this receiving cage that is then picked up with the therein submersible vehicle and placed on the deck of the mother ship or a corresponding base station.

The problem here is that such a pick-up cage is relatively large and costly to manufacture. In addition, the submersible vehicle is hardly accessible on the deck of the ship when it is in this receiving cage.

SUMMARY

Thus, the object of the present invention is to address at least one of the mentioned problems. In particular, a solution is to be proposed that allows pick-up of an autonomous submersible vehicle at relatively low cost and also at moderately rough seas. Preferably, the picked-up submersible vehicle should also be relatively easily accessible once it is on-board the ship. At least an alternative solution is to be proposed.

According to the invention a method according to claim 1 is proposed. Accordingly, the mother ship for pick-up of the autonomous submersible vehicle first releases a floating line, optionally together with a buoy. Thus, this floating line is pulled along behind the mother ship while it continues its onward journey. In this state, the submersible vehicle allows rise of at least a part of a capturing line using a capturing buoy. One end of the capturing line is attached to the submersible vehicle while the capturing buoy is attached to the other end of the capturing line. The capturing buoy rises and draws out at least a part of the capturing line, away from the submersible vehicle, upwards along with it towards the water surface. The submersible vehicle is submerged as a result, e.g. to a depth of 5 m, and therefore, it is hardly subject to rough seas at that depth. The capturing buoy now drives on the water surface and is connected to the submersible vehicle via the capturing line. The capturing line allows rising, preferably not completely, but only partly.

In this state, the submersible vehicle now passes under the floating line, i.e. it passes under the floating line in the submerged state. This movement can be carried out at a right angle to the floating line, but the underpass can also be oblique. Here, the submersible vehicle pulls the capturing buoy against the floating line. The floating line stays afloat, but is comparatively lower in the water. The capturing buoy also stays afloat, but is largely above the water surface and therefore, tends to move beyond the floating line when crossing the same. In the process, the capturing line runs from the capturing buoy to the submerged submersible vehicle, so that the capturing line with the capturing buoy is caught on the floating line, especially by a hook on the floating line, so that the hook essentially encompasses the floating line.

The submersible vehicle can now be drawn to the mother ship by picking up the floating line. Thus, the submersible vehicle is connected to the mother ship via the capturing line and the floating line.

Preferably, the submersible vehicle passes under the floating line such that the capturing buoy hooks with a catch means, in particular, a catch hook on the floating line. The capturing buoy is designed, in particular, relatively flat, wide and/or long for this purpose and has this catch hook that is generally pointed downward and with an opening to the front. Thus, the floating line is drawn into this catch hook by passing under the floating line with the submersible vehicle. Preferably, the catch hook has a securing device or mechanism that prevents the floating line from sliding back out of the catch hook.

By the forward movement of the mother ship that should be as moderate as possible, e.g. at a speed of two knots through the water, the catch means, in particular, the catch hook slides to one end of the floating line. The floating line is naturally designed at its end such that it does not slip from the catch hook there. Once the catch hook and thus, the capturing buoy have reached the end of the floating line, the capturing buoy and the submersible vehicle are drawn by the mother ship.

During this pick-up operation, at least the intended driving course that is controlled by the submersible vehicle is preferably compared with the actual driving course of the submersible vehicle. When passing under the floating line the submersible vehicle is preferably driven more or less transversely to the floating line and therefore, at least in one embodiment, transverse to the direction of the mother ship.

By hooking onto the floating line and pulling the submersible vehicle over the floating line and capturing line the submersible vehicle is pulled towards the mother ship. If a significant deviation is now detected during the inspection of the intended driving course of the submersible vehicle, this is due to said pulling of the submersible vehicle by the mother ship, so that successful hooking of the capturing buoy or the catch hook onto the floating line is identified by this deviation in the driven course. A significant deviation is to be assumed when a predetermined threshold is exceeded. Preferably, this deviation of more than 30 degrees is between the controlled driving course and the actual driving course.

According to another embodiment it is proposed that the end of the floating line that faces away from the mother ship is provided with a location buoy that is let out along with the floating line, and that the location buoy has a location transmitter and the location transmitter sends a location signal, so that the submersible vehicle can locate the location buoy, and that another location transmitter is optionally provided at the stern of the mother ship, especially at the floating line or released otherwise into the water, and that the submersible vehicle passes under the floating line between the location buoy and the other location transmitter.

Thus, the mother ship basically draws the location buoy behind it by means of the floating line. The location buoys location transmitter transmits a location signal that is designed, in particular, as a sonar. Thus, the submersible vehicle can detect the position of this location buoy. Moreover, the position of the mother ship can be known to the submersible vehicle, or due to movement of the location buoy, namely the fact that the mother ship sails, the submersible vehicle may also detect the position of the mother ship, and thus, the area in which the floating line is let out and is to be traversed below for a known length of the floating line. Preferably, another location transmitter is provided at the stern of the mother ship, in particular, in such a manner that it is released into the water at the floating line and is then positioned directly behind the stern of the ship. If this also transmits location signals, the submersible vehicle can locate the location buoy and the other location transmitter. The floating line must be arranged in between and therefore, the submersible vehicle basically passes under a line that runs at the level of the water surface between the location buoy and the other location transmitter.

Thus, the submersible vehicle can easily determine the approximate location, where the floating line is laid in water or at the water surface and the submersible vehicle passes under the floating line there.

Before passing under the floating line, the submersible vehicle initially allows the rise of preferably, only a part of the capturing line so that the submersible vehicle with a shortened capturing line passes under the floating line. Only after the capturing line with the capturing buoy is caught on the floating line, the remaining part of the capturing line can be drawn from a receiving cage of the submersible vehicle.

In particular, this remaining part can be drawn from the receiving cage of the submersible vehicle by a pulling on the capturing line using the floating line. Such a receiving cage can be designed as a recording cassette or compartment or to mention another example, a pick-up roller on which the capturing line is first wound may be provided. However, rising of the capturing line even in this case always refers to the fact that this is always attached at one end to the submersible vehicle.

Thus, it can be achieved that length of the capturing line when passing under the floating line is different when the submersible vehicle is picked up by the mother ship. Thus, the shorter length can be adapted to the immersion depth of the submersible vehicle during pick-up and it is thus, adapted to passing under the floating line such that the capturing line with its capturing buoy can get caught well on the floating line.

A longer line can be advantageous for picking up the submersible vehicle, especially when the submersible vehicle approaches the mother ship, so as to avoid any collisions between the mother ship and the submersible vehicle.

Another embodiment of the method proposes that the submersible vehicle is brought to the mother ship and then, when the submersible vehicle is close to the mother ship, in particular, within the range of a deck crane, a lifting gear of the deck crane is guided to the submersible vehicle. This guidance can be done by the capturing line. When picking up the floating line, the submersible vehicle is thereby drawn to the ship at the capturing line and an end of the capturing line, at which the capturing buoy is arranged, is thereby drawn by the floating line to the mother ship.

According to one embodiment, it is proposed to guide a lifting gear of the deck crane on the capturing line to a lifting anchor of the submersible vehicle. Such a lifting gear can be designed—according to a simple example—as a cable or line that is placed in a loop and said loop is guided along the capturing line by placing the capturing line in the loop, thus leading the loop to the lifting anchor. The lifting anchor is, in particular, arranged at the top of the submersible vehicle approximately above the center of gravity of the submersible vehicle. The lifting anchor can be designed as a hook, in particular, with a locking mechanism, and be anchored in the submersible vehicle. The loop mentioned as an example is then preferably guided along the capturing line in this hook. With the help of the locking mechanism—if available—a fixed and secure connection between the deck crane and submersible vehicle can be produced, namely via said lifting anchor and said lifting gear.

The lifting gear or excavation gear can also be guided with the help of a support line to the lifting anchor of the submersible vehicle, instead of or in addition to any guidance by the capturing line. The support line is an additional line provided on the submersible vehicle. It is also proposed that the support line is provided on the submersible vehicle. It is attached at one end to the submersible vehicle more or less in the region of a lifting anchor, in particular, of a corresponding hook. At the other end, it is attached to the capturing line, approximately in a central region of the capturing line. If the capturing line is recovered by the floating line from the mother ship, in particular, by its winch, this support line also reaches the mother ship at its end attached to the capturing line when the submersible vehicle has been pulled close to the mother ship. Then, this support line can be used to at least temporarily fasten the submersible vehicle directly or indirectly to the mother ship. The support line can also be used now to guide the lifting gear or excavation gear at this support line to the lifting anchor of the submersible vehicle.

According to the invention, proposed is also an autonomous submersible vehicle that is prepared by a method according to an embodiment described above for being picked up by a mother ship. In particular, the autonomous submersible vehicle is prepared to the extent that it has a capturing line with capturing buoy and that a release mechanism is intended for releasing the capturing buoy and at least part of the capturing line.

According to one embodiment, it is proposed that an end of the capturing line is attached to the submersible vehicle in the area of lifting anchor, in particular, in an upper central region of the submersible vehicle. Moreover, for this embodiment, it is proposed that a central portion of the capturing line is attached to the front of the submersible vehicle. In this way, a part of the capturing line along with the capturing buoy can be risen by the submersible vehicle so that the capturing buoy rises with a part of the capturing line, namely more or less up to the middle portion of the capturing line, which is fixed at the front of the submersible vehicle. Thus, it is possible in a simple manner to initially allow rise of only a part of the capturing line.

Preferably, the capturing line is stowed in whole or in part in a front cassette on the submersible vehicle, wherein a release mechanism is provided which can allow rise of a part of the capturing line on this front cassette along with the capturing buoy, in particular, so that another part of the capturing line initially remains in the cassette.

According to the invention, a vehicle assembly, comprising an autonomous submersible vehicle and a mother ship to pick up the submersible vehicle is also proposed. The autonomous submersible vehicle is designed in accordance with at least one embodiment described above or as can be seen from at least one embodiment of the proposed method for pick-up of the autonomous submersible vehicle.

The mother ship has a release and pick-up device for releasing and recovering the floating line. Such a release and pick-up device is preferably designed as a motor-operated winch. Furthermore, the mother ship has a base station for receiving the submersible vehicle. Such a base station can be permanently installed on the mother ship, or it can be temporarily arranged as a mobile base station, for example, for a trip on the mother ship. Such a mobile base station is preferably configured as a container unit.

BRIEF DESCRIPTION OF THE DRAWINGS

The invention is exemplified in more detail by way of embodiments with reference to the accompanying drawings.

DETAILED DESCRIPTION

FIGS. 1 to 7 illustrate step-by-step the pick-up process and Attaching a submersible vehicle, to be picked up by a mother ship, including any proposed arrangements.

Figure 1:
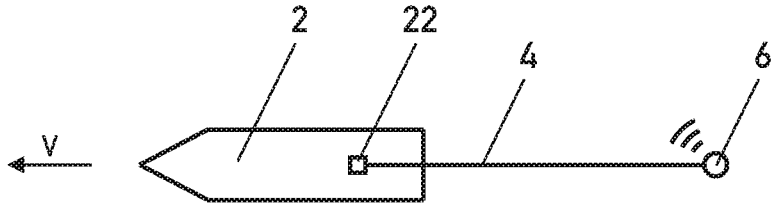
FIGS. 1 to 7 illustrate a method for picking up an autonomous watercraft, based on positions and/or behavior of the mother ship and/or the autonomous submersible vehicle.

FIG. 1 also shows a gently moving forward mother ship 2 that has let out a floating line 4 with location buoy 6 from behind. The floating buoy 6 is prepared for housing a wireless and GPS receiver in order to represent the position of the buoy 6. The buoy is equipped with a sonar transmitter and a signal or position light and it is connected to the floating line 4.

The buoy 6 is thrown from the deck at the stern of the mother ship 2 into the water. An electric winch unwinds the floating line 2, namely to about 80 m, while the mother ship moves forward slowly at a speed of about 1 knot to support the unwinding process. Preferably, it is proposed to arrange another sonar transmitter outside the stern of the mother ship, in addition to the sonar transmitter of location buoy 6.

Once the location buoy 6 is at a suitable distance to the mother ship, the autonomous submersible vehicle to be picked up will be prompted by an acoustic submersible modem to start the pick-up process.

Figure 2:
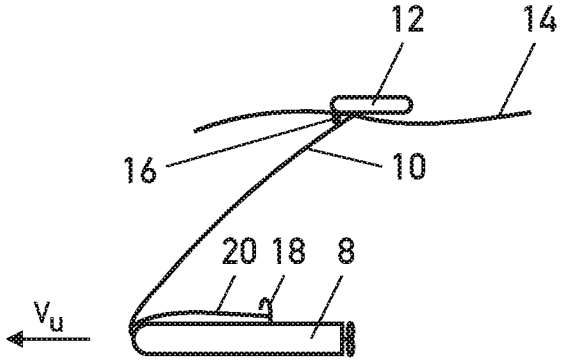

To this end, the submersible vehicle is commanded to a particular position from which it can securely pass under the floating line 4 between the mother ship and the 2 location buoy 6. A capturing buoy of the submersible vehicle is released on command and the submersible vehicle, which is submerged approximately to a depth of 5 m, draws the capturing buoy, which is provided with a downwardly pointing hook, from behind. This scenario is illustrated schematically in FIG. 2, in which the submersible vehicle 8 draws a capturing buoy 12 via a capturing line 10, wherein the capturing buoy 12 essentially floats on the water surface 14. The capturing buoy 12 is equipped with a hook 16, that substantially points down. FIG. 2 illustrates an autonomous submersible vehicle 8 also with a lifting anchor 18 having a catch hook for engagement.

The speed $V_U$ of the autonomous submersible vehicle 8 is, for example, two knots. The total length of the capturing line 10 is, for example, about 25 m.

Preferably, the process described above can be carried out automatically by automatically issuing a pick-up command to the autonomous submersible vehicle 8 via the acoustic link. The submersible vehicle 8 will automatically release the capturing buoy and pass under the floating line between the two sonar transmitters.

A support line 20, which can be, for example 15 m long, connects the lifting anchor 18, in particular, the indicated hook, with the capturing line, e.g. after a length of 9 m. This support line 20 is stowed in a front cassette in the submersible vehicle 8. The capturing line 10 is initially not fully withdrawn by the capturing buoy 12, but is limited to a length whose value is slightly larger than the immersion depth of the autonomous submersible vehicle 8. This length to which the capturing line 10 is first drawn, can be limited, for example to 8 m. The remaining 17 m, to continue with the above example, is mechanically pulled out when the submersible vehicle 8 is drawn behind the mother ship.

Figure 3:
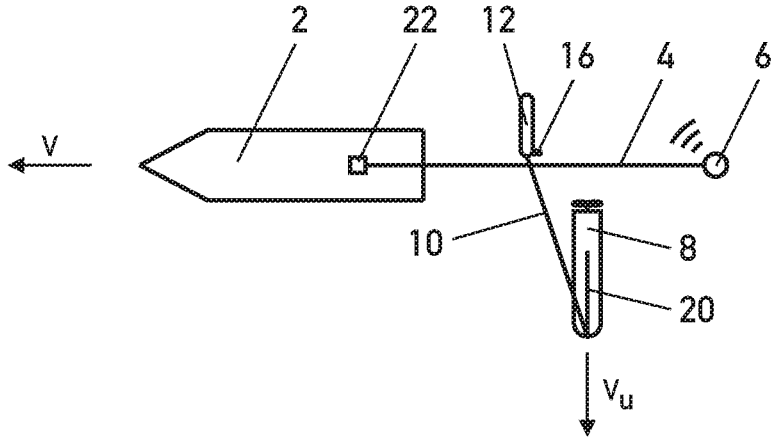

FIG. 3 illustrates passing of the submersible vessel 8 under the floating line 4 at the speed $V_U$ of the submersible vehicle 8.

By passing under, the capturing buoy 12 is drawn against the floating line 4 such that the floating line 4 enters the catch hook 16.

Figure 4:
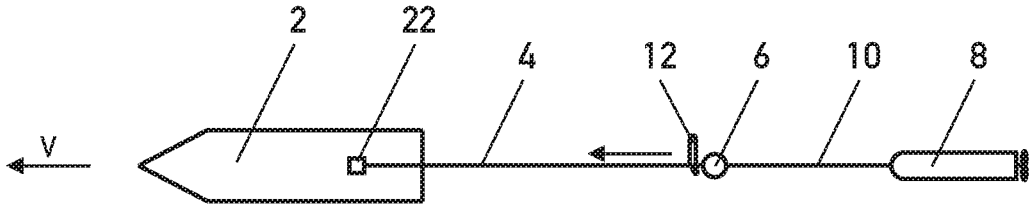

Due to the forward motion V of the mother ship 2, the floating line 4 will slide through the catch hook 16 until this hook on the location buoy 6 has reached the end of the floating line 4. This scenario is illustrated in FIG. 4.

By the pulling force of the mother ship 2, the submersible vehicle is drawn with its bow towards the mother ship 2. This effect of drawing is detected by the navigation software of the submersible vehicle and the engines of the submersible vehicle are stopped. The detection occurs based on the fact that the specified or commanded direction is different from the actual direction by more than 30 degrees. This check is only active during a pick-up process, so as to avoid any malfunctions during an investigation trip, exploratory trip or the like of the submersible vehicle.

The floating line 4 is then picked up by the winch until both buoys, namely location buoy 6 and capturing buoy 12, are on deck of the mother ship 2. The support line 20 is then attached to the base station as long as the pulling force from the mother ship 2 still acts on the submersible vehicle 8 via the floating line 4 and the capturing line 10. The winch 22 that is only shown schematically on some of the figures will again let out the floating line a bit, namely to the extent that the pulling force is no longer transmitted via the floating line 4 and the capturing line 10, but the support line 20. The speed of the mother ship 2 here is very low or even zero. Both buoys, namely the location buoy 6 and the capturing buoy 12, can then be removed safely and the floating line 4 and the capturing line 10 are connected. This procedure prevents any accidents that could be caused by a pulling force in the lines.

Figure 5:
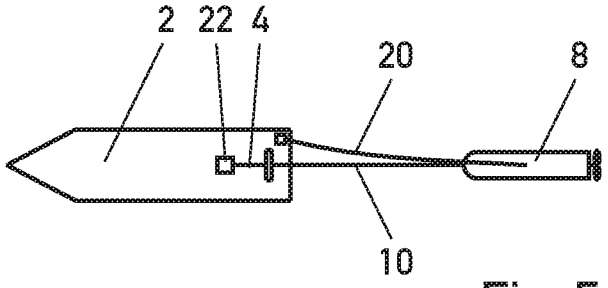

The winch 22 then continues to rewind while excavation or lifting gear, such as a lifting line, is installed on a crane hook, in particular, a conventional crane hook of a deck crane. FIG. 5 shows the scenario in which the support line 2 is attached to a base station on the mother ship and thus, to the mother ship. If the submersible vehicle 8 was brought close to the mother ship 2 used by rewinding of the winch 22, a crane hook is arranged above the submersible vehicle 8. The lifting gear or the excavating gear that can be designed as a lifting line that is placed in a loop can be guided along the support line 20 to the hook of the lifting anchor 18.

Figure 6:
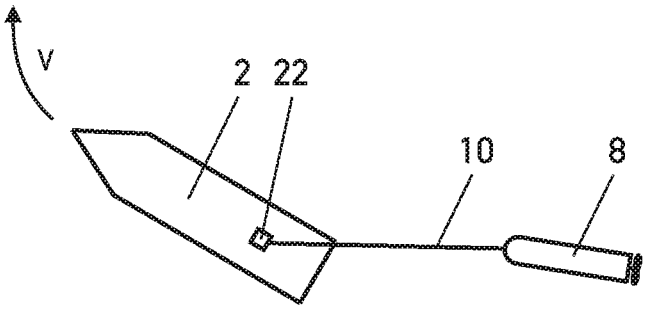

If the deck crane is only located on the side of the mother ship 2 and can pick up the submersible vehicle 8 only there, the mother ship 2 should make a turn, which is indicated in FIG. 6.

Figure 9:
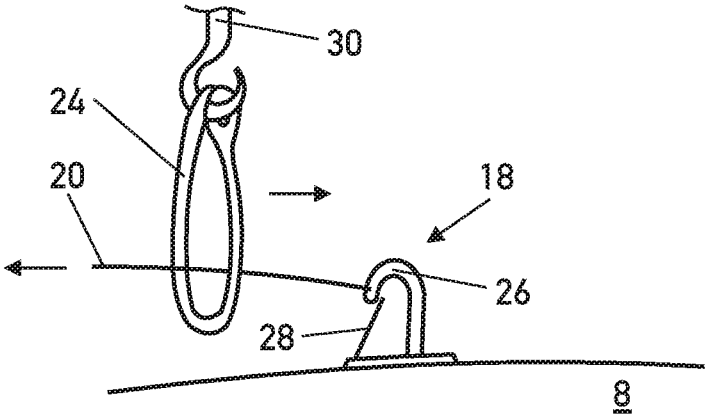
FIG. 9 illustrates the guidance of a lifting gear to a lifting anchor of an autonomous submersible vehicle.

FIG. 9 illustrates the guidance of the lifting line 24, which is the lifting gear or excavating gear here, along the support line 20 to the lifting hook 26 of lifting anchor 18 of the submersible vehicle 8. The lifting hook 26 also has a locking mechanism 28, which prevents the lifting line 24 from slipping out of the lifting hook 26 as soon as it has reached its position there. The submersible vehicle 8 can then be raised above the crane hook 30 by a crane.

Figure 10:
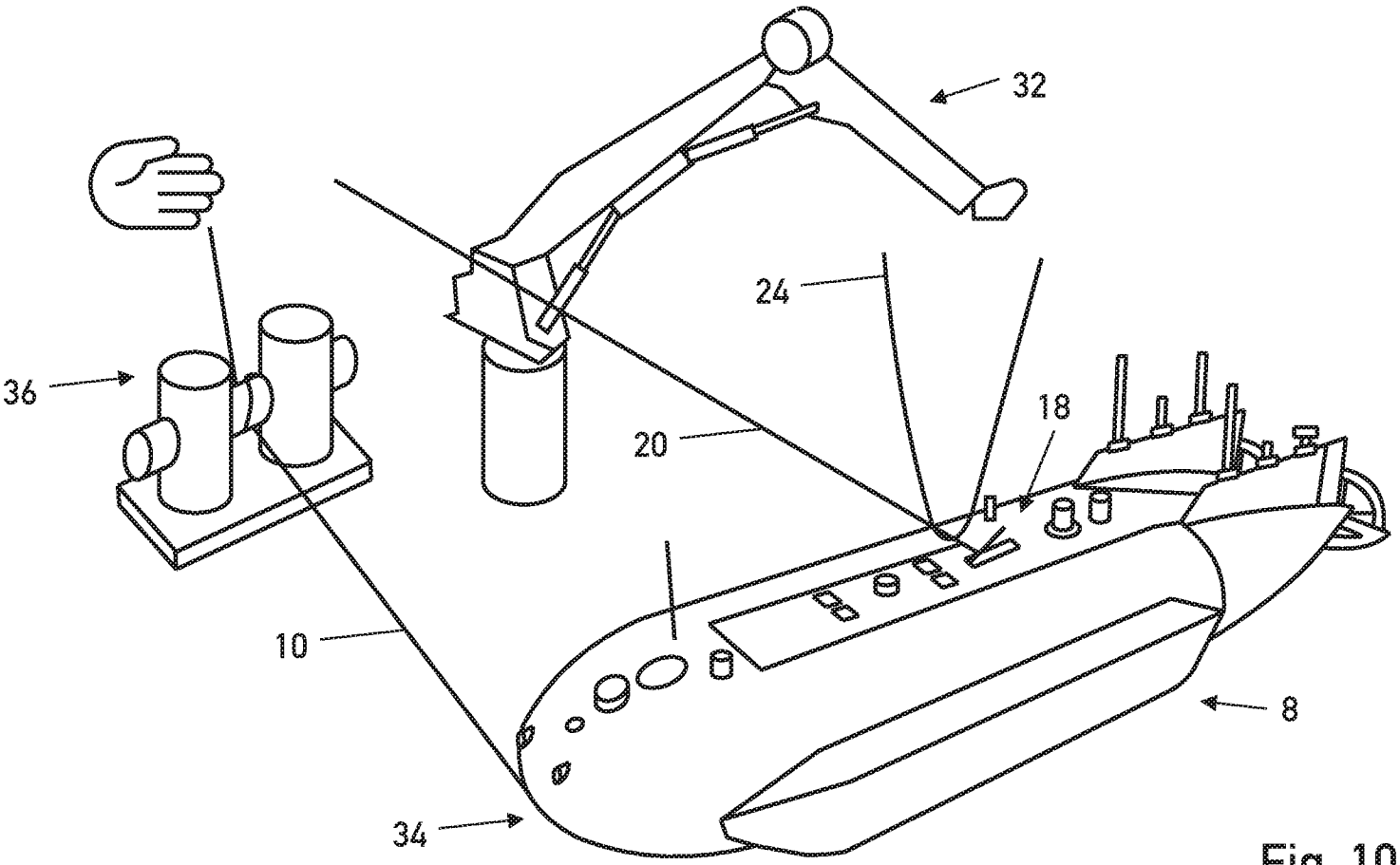
FIG. 10 illustrates the guidance of a lifting gear to a lifting anchor of an autonomous submersible vehicle in another illustration.

In comparison with FIG. 9, FIG. 10 shows an overview and partly schematically illustrates how a lifting line 24 can be guided to a lifting anchor 18. To this end, the submersible vehicle 8 is attached to its bow 34 with the capturing line 10 at a mooring line 36. The mooring line 36 is located on the mother ship, so as to allow the submersible vehicle 8 being drawn at this capturing line 10 behind the mother ship, if the mother ship moves ahead at least with a low drive. Instead of the mooring line 36, using a winch same as the winch 22 in FIGS. 1-8 is proposed, wherein the submersible vehicle is attached via the capturing line 10. A crane 26, which is also attached to the mother ship, has the lifting line 24, wherein the specific attachment of the lifting line 24 onto the crane 26 is not shown because the crane 26 is shown here only symbolically. The support line 20 is attached to the lifting anchor 18 and is also guided to the mother ship. The lifting line 24 is placed in a loop around this support line 20 and thus, can be guided along this to the submersible vehicle 8, namely to the lifting anchor 18.

Figure 7:
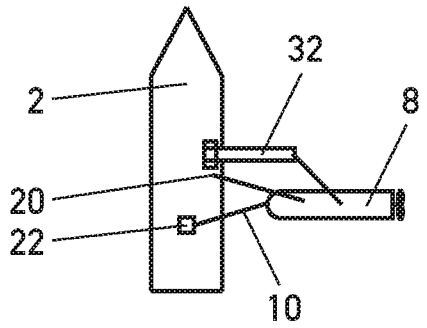

FIG. 7 shows a position of the lateral pick-up of the submersible vehicle 8 by a crane 32 onto the mother ship. 2 Referring to FIG. 7, which also applies to the other figures, in particular, FIGS. 1-8, it should be noted that the illustrations provide an overview and in particular, the scale need not reflect reality. In particular, the submersible vehicle 8 is usually significantly smaller than the mother ship 2.

FIG. 7 shows that the submersible vehicle 8 is brought very close to the mother ship 2 by means of the winch 22 and the capturing line 10. The submersible vehicle 8 can now be lifted by the crane 32, wherein the support line 20 can be used as auxiliary means.

Figure 8:
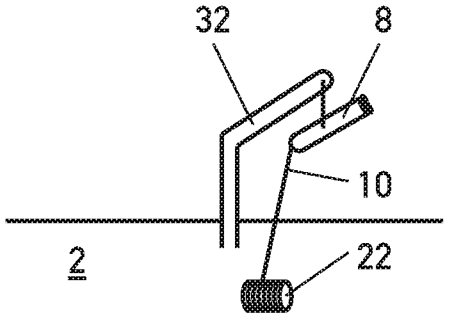
FIG. 8 illustrates a controlled, vibration-reduced lifting and getting an autonomous submersible vehicle on deck.

To avoid or at least reduce swaying of the submersible vehicle 8 while hanging on the crane 32, the winch 22 continues to exert a pulling force on the submersible vehicle 8 via the capturing line 10; this is indicated in FIG. 8. Preferably, the winch 22 can be turned on a corresponding rotary support, such as a turntable, towards the bow of the submersible vehicle 8. This is done basically passively or automatically by the applied pulling forces between the winch 22 and the submersible vehicle 8.

Preferably, the autonomous submersible vehicle is equipped with a capturing buoy with hook and capturing line that is attached to the nose of the autonomous submersible vehicle. Further, a trigger or release mechanism is provided in order to release the capturing buoy, and thus, also release a corresponding part of the capturing line fixed to the capturing buoy. The submersible vehicle has a bow hook that allows the submersible vehicle to navigate through the water at a speed of three knots. Preferably, two cassettes are provided to take up the lines. Furthermore, a load hook is provided in the central region of the autonomous submersible vehicle to lift it. This is, in particular, part of a lifting anchor of the submersible vehicle.

Preferably, an acoustic modem is provided, including adaptation to command or direct the submerged autonomous submersible vehicle via an acoustic modem. Preferably, the submersible vehicle is intended for implementation of an automatic retrieval and an automatic pick-up, if this relates to actions of the submersible vehicle.

Figure 11:
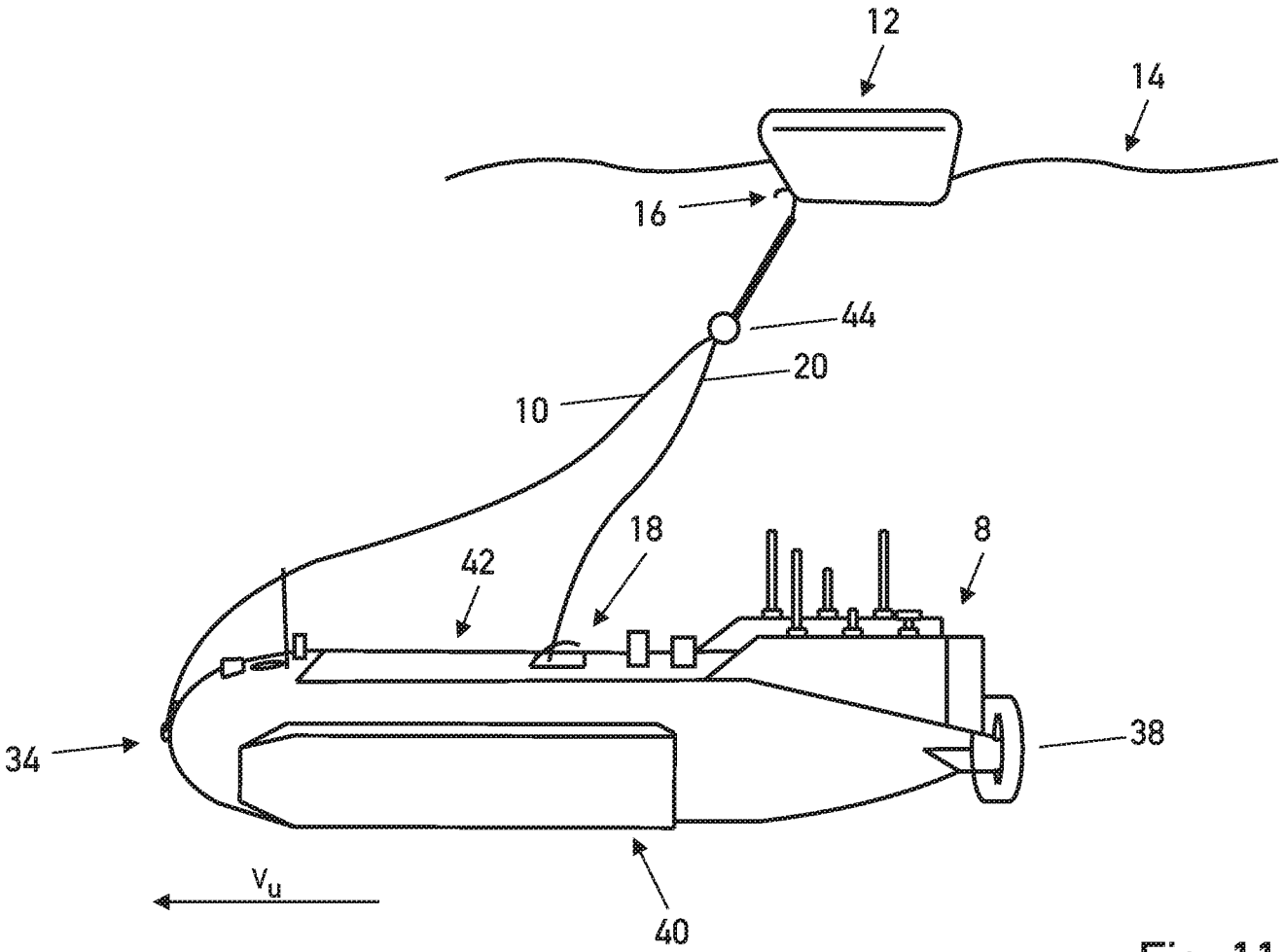
FIG. 11 shows an autonomous submersible vehicle in a state ready for pick-up.

FIG. 11 shows an submersible vehicle 8, with a bow 34, stern 38, bottom side 40 and upper side 42. A capturing line 10 is arranged at the bow 34 of the submersible vehicle 8 and leads to a capturing buoy 12 that floats on the water surface 14. The capturing buoy 12 also has a catch hook 16, which faces forward, as the submersible vehicle 8 moves forward at a low speed $V_U$ while pulling the capturing buoy 12 in that direction.

On the upper side 42 of the submersible vehicle 8 and in the vicinity of a lifting anchor 18, a support line 20 that is mounted in a central region of the capturing line 10 is fixed. An attachment point in this central region bears the reference number 44 and is only schematically indicated in the FIG. 11. In particular, the length ratios between the length of the submersible vehicle 8, the lengths of the capturing line 10 and support line 20 and the actual position of the attachment point 44 are not representative of the actual scale.

The invention claimed is:

1. A method for pick-up of an autonomous submersible vehicle in a mother ship, comprising the steps:

letting out a floating line from the mother ship, so that the floating line runs at a level of a water surface, allowing rise of at least part of a capturing line using a capturing buoy from the submersible vehicle, wherein a first end of the capturing line is attached to the submersible vehicle and a second end of the capturing line is attached to the capturing buoy so that the capturing buoy floats at a water surface, passing under the floating line with the submersible vehicle so that the capturing line with the capturing buoy is caught on the floating line, and pulling the submersible vehicle to the mother ship by picking up the floating line.

2. Method according to claim 1, wherein:

the submersible vehicle passes under the floating line such that capturing buoy hooks onto the floating line using a catch device; and the catch device slides to the end of the floating line through the forward motion of the mother ship.

3. Method according to claim 1, wherein a driving course that is controlled by the submersible vehicle is compared with an actual driving course of the submersible vehicle and a deviation above a predetermined threshold, confirms successful hooking of the capturing buoy to the floating line.

4. Method according to claim 1, wherein:

an end of the floating line that faces away from the mother ship is provided with a location buoy that is released along with the floating line, the location buoy has a location transmitter and the location transmitter transmits a location signal so that the submersible vehicle can locate the location buoy, and another location transmitter is provided at the stern of the mother ship at the floating line or is released otherwise into the water, and the submersible vehicle passes under the floating line between the location buoy and the another location transmitter.

5. Method according claim 1, wherein:

the submersible vehicle allows rise of a part of the capturing line before passing under the floating line, so that the submersible vehicle passes under the floating line with a shortened capturing line and a remaining part of the capturing line can be drawn from a receiving cage of the submersible vehicle, after the capturing line with the capturing buoy has been caught on the floating line, wherein one end of the capturing line remains fixed on the submersible vehicle.

6. Method according to claim 1, wherein:

the submersible vehicle is brought to the mother ship, and a lifting gear of a deck crane is guided along the capturing line or a support line to a lifting anchor of the submersible vehicle.

7. Autonomous submersible vehicle comprising:

a capturing line with a capturing buoy;

a release mechanism for releasing the capturing buoy and at least part of the capturing line; and a floating line configured to run at a level of a water surface such that if the submersible vehicle passes under the floating line, the capturing line with the capturing buoy is caught on the floating line.

8. Autonomous submersible vehicle according to claim 7, wherein:

one end of the capturing line or a first end of a support rope is fixed on a submersible vehicle in a region of a lifting anchor; and a central portion of the capturing line is attached in a front area of the submersible vehicle, and/or a second end of a support line is attached to the central region of the capturing line.

9. Autonomous submersible vehicle according to claim 8, wherein: the capturing line is stored in a front cassette on the submersible vehicle and can rise at least partially from there.

10. Vehicle assembly comprising an autonomous submersible vehicle according to claim 7, and a mother ship for picking up the submersible vehicle, wherein the mother ship comprises a release and pick-up mechanism for discharging and recovering the floating line and a base station for picking up the submersible vehicle.

11. The method according to claim 3 wherein the predetermined threshold is above 30° C.

12. A method according to claim 2 wherein the catch device is a catch hook.

13. The autonomous submersible vehicle of claim 8 wherein one end of the capturing line or a first end of a support rope is fixed on the submersible vehicle in an upper, central region of the submersible vehicle.

* * * * *